US009630219B2

(12) United States Patent
Templeton

(10) Patent No.: US 9,630,219 B2
(45) Date of Patent: Apr. 25, 2017

(54) AIR SHOWER FOR DUST COLLECTORS

(71) Applicant: Associated Research—EDC Ltd, Calgary (CA)

(72) Inventor: Matthew Charles Templeton, Calgary (CA)

(73) Assignee: Associated Research-EDC Ltd, Calgary (CA)

( * ) Notice: Subject to any disclaimer, the term of this patent is extended or adjusted under 35 U.S.C. 154(b) by 0 days.

(21) Appl. No.: 14/809,108

(22) Filed: Jul. 24, 2015

(65) Prior Publication Data

US 2016/0022104 A1 Jan. 28, 2016

Related U.S. Application Data

(60) Provisional application No. 62/029,076, filed on Jul. 25, 2014.

(51) Int. Cl.

| | |
|---|---|
| ***A47L 9/10*** | (2006.01) |
| ***A47L 5/00*** | (2006.01) |
| ***B08B 5/02*** | (2006.01) |

(52) U.S. Cl.

CPC ..... *B08B 5/02* (2013.01)

(58) Field of Classification Search

CPC .. B08B 5/02; F24F 7/007; A47L 9/106; A47L 9/127; A47L 9/1683; A47L 5/00; A47L 5/28

See application file for complete search history.

(56) References Cited

U.S. PATENT DOCUMENTS

| | | | | |
|---|---|---|---|---|
| 4,267,769 A | | 5/1981 | Davis et al. | |
| 4,578,840 A | | 4/1986 | Pausch | |
| 4,624,690 A | | 11/1986 | Byrnes | |
| 4,765,352 A | | 8/1988 | Strieter | |
| 4,774,974 A | | 10/1988 | Teter | |
| 4,883,512 A | * | 11/1989 | Griffis | B01D 46/00 135/121 |
| 4,967,645 A | | 11/1990 | Mattson | |
| 5,030,259 A | | 7/1991 | Bryant et al. | |

(Continued)

FOREIGN PATENT DOCUMENTS

| | | |
|---|---|---|
| CN | 103464420 | 12/2013 |
| KR | 101449938 | 10/2014 |
| WO | WO2014053079 | 4/2014 |

OTHER PUBLICATIONS

Abtech Inc., "Cleanroom Air Showers," http://www.abtech.net/airshowers.html, at least as early as Apr. 2, 2015, 2 pages.

ASPT, "Air Showers and Pass Thrus," Copyright © 2014 ASPT.com, all rights reserved, www.airshower.com/?gclid_CLL2kM=O2MQCFYdgfgodJ08AQQ, at least as early as Apr. 2, 2015, 1 page.

Clean Air Products, "Cleanroom Air Showers," www.cleanairproducts.com/product-category/air-showers/, at least as early as Apr. 2, 2015, 5 pages.

(Continued)

*Primary Examiner* — Dung Van Nguyen

(74) *Attorney, Agent, or Firm* — Law Office of Karen Dana Oster, LLC

(57) ABSTRACT

An air shower system, as described herein, is for use with a dust collector having an intake vacuum. The system includes a chamber having at least one vacuum orifice and at least one air blade orifice. The intake vacuum is functionally connected to the vacuum orifice(s). At least one air blade is created when the intake vacuum draws air from the exterior of the chamber into the interior of the chamber through the air blade orifice(s). The air blade(s) may be used for dislodging contaminants from an occupant within the chamber.

33 Claims, 9 Drawing Sheets

(56) References Cited

U.S. PATENT DOCUMENTS

| | | | | |
|---|---|---|---|---|
| 5,558,112 | A * | 9/1996 | Strieter | B09B 3/0066 134/103.2 |
| 5,692,954 | A | 12/1997 | Lee et al. | |
| 5,746,652 | A | 5/1998 | Lee et al. | |
| 5,816,908 | A | 10/1998 | Tsou | |
| 5,840,102 | A | 11/1998 | McCracken | |
| 6,773,554 | B1 | 8/2004 | Moore, Jr. | |
| 7,134,444 | B2 * | 11/2006 | Mintie | B08B 15/00 135/131 |
| 7,147,553 | B2 * | 12/2006 | Leask | F24F 3/1607 131/240.1 |
| 7,430,784 | B1 | 10/2008 | Cowan | |
| 7,465,225 | B2 | 12/2008 | Ohmura et al. | |
| 7,887,614 | B2 | 2/2011 | Yamazaki et al. | |
| 9,073,473 | B2 | 7/2015 | Cramer | |

OTHER PUBLICATIONS

Esco Micro Pte Ltd, "Cleanroom Air Showers," © 2015 Esco Micro Pte Ltd, all rights reserved, www.escoglobal.com/product/containment-pharma-products/cleanroom-air-showers/EAS/, at least as early as Apr. 2, 2015, 3 pages.

Innotech Products Inc., "Air Shower for Cleanroom Personnel," www.innotechprod.com/personnel-air-shoewrs.html, at least as early as Apr. 2, 2015, 2 pages.

terra universal.com, "Air Showers for Cleanrooms," copyright 1999-2015 Terra Universal, Inc. all rights reserved, www.terrauniversal.com/cleanroom-passthroughs/clean-room-air-showers.php, at least as early as Apr. 2, 2015, 4 pages.

* cited by examiner

AIR SHOWER FOR DUST COLLECTORS

The present application is an application claiming the benefit of U.S. Provisional Patent Application No. 62/029,076, filed Jul. 25, 2014. The present application is based on and claims priority from this application, the disclosure of which is hereby expressly incorporated herein by reference in its entirety.

BACKGROUND OF THE INVENTION

Disclosed herein is an air shower for dust collectors and, more particularly, in-line "air blade" showers for mobile dust collectors.

Inhalable and/or respirable silica dioxide ($SiO_2$) is a major problem facing the oil and gas (O&G) industry. Silica dioxide is a commonly occurring element found in two forms—crystalline and amorphous. Quartz and sand are common examples of crystalline silica. Silica dioxide is particularly hazardous when it is broken down, creating inhalable or respirable silica dust (very small crystalline particles and/or amorphous particles). The Center for Construction Research and Training (CPWR) has stated that "inhaling crystalline silica dust can lead to silicosis, bronchitis, or cancer as the silica dust becomes lodged in the lungs and continuously irritates them." According to the World Health Organization (WHO), whenever people inhale airborne silica dust at work, they are at risk of occupational disease. Year after year, both in developed and in developing countries, overexposure to silica dust causes disease, temporary and permanent disabilities and deaths. Silica dust in the workplace may also contaminate or reduce the quality of products, be the cause of fire and explosion, and damage the environment.

Field workers in the O&G industry are exposed to silica dust which can cause silicosis through over exposure. While personal protective equipment (PPE) is generally employed to prevent exposure, secondary exposure (for example, from residual silica dust on clothing) is sometimes forgotten.

Generally, air shower systems are used to remove contaminants from a person before or after they enter or leave a clean room. Clean rooms are used so that the person will be as free from contaminants as possible before they enter "sterile" facilities such as hospital operating rooms, research laboratories, semiconductor fabrication facilities, and pharmaceutical fabrication facilities. It is imperative that these facilities be free from contaminants such as dirt, dust, skin cells, bacteria, and mold.

In use, a person enters the air shower through a door that then closes behind him. Known air showers use a large air pumping system to power air flow. The air pumping system may include a fan and/or compressed air. (The use of compressed air necessitates an additional, substantially larger, air tank to supply the demands of the air shower. Compressed air also presents a health risk to people as the high pressure can cause injuries, such as a failure in the regulating system that could cause tissue damage.) Once inside the air shower, air nozzles (installed on the vertical walls and/or the ceiling of the air shower) blow air onto a person's surfaces to remove contaminants. Exhausted air and contaminants are removed from the air shower via air discharge holes. The contaminants may be filtered from the air, and may be stored if required by laws relating to the collection and disposal of contaminants. The filtered air is either recirculated through the air shower or is exhausted out into the environment. These known air showers are generally large and expensive. Known air showers require their own transport and possibly even a crane to move them. The expense and difficulties associated with known air showers limits their utility.

Patents describing known air shower systems include U.S. Pat. No. 4,267,769 to Davis et al. (the "Davis reference"), U.S. Pat. No. 4,624,690 to Byrnes (the "Byrnes reference), U.S. Pat. No. 4,765,352 to Strieter (the "'352 Strieter reference"), U.S. Pat. No. 4,967,645 to Mattson (the "Mattson reference"), U.S. Pat. No. 5,558,112 to Strieter (the "'112 Strieter reference"), U.S. Pat. No. 5,692,954 to Lee et al. (the "'954 Lee reference"), U.S. Pat. No. 5,746,652 to Lee et al. (the "'652 Lee reference"), U.S. Pat. No. 5,816,908 to Tsou (the "Tsou reference"), U.S. Pat. No. 7,465,225 to Ohmura et al. (the "Ohmura reference"), U.S. Pat. No. 7,887,614 to Yamazaki et al. (the "Yamazaki reference"), Patent Cooperation Treaty (PCT) Application No. PCT/CN2012/082839 to Tianjin Tianxing Electronics Co., Ltd. et al. (the "Tianjin reference"), Chinese Patent No. 103464420 to Weiping et al. (the "Weiping reference"), and Korean Patent No. 10-1449938 to Cho (the "Cho reference").

What is relatively common in the O&G field are mobile vacuum systems (also referred to as "dust collectors") designed to capture and remove silica dust during on-site O&G operations. Fracking, specifically, requires large volumes of sand (hundreds or even thousands of tons) to be pumped downhole. This sand is generally silica sand, and, therefore, any movement of the sand generates silica dust. The use of coated sand can lower the generation of silica dust, but it is not cost effective. Washing the sand is similarly costly and any further movement of the sand will simply create new silica dust particles through impaction. PPE can be worn to protect workers, but this is considered a last resort and does not help when site operations are near residential areas.

Known mobile dust collectors are large trailer mounted units capable of moving very large volumes of air at low pressure. Exemplary dust collectors include, but are not limited to, the mobile vacuum machine described in U.S. Pat. No. 4,578,840 to Pausch (the "Pausch reference"), the portable vacuum cleaning system described in U.S. Pat. No. 5,030,259 to Bryant et al. (the "Bryant reference"), the mobile pneumatic material transfer machine described in U.S. Pat. No. 5,840,102 to McCracken (the "McCracken reference"), the vacuum-cleaning apparatus for a stable described in U.S. Pat. No. 7,430,784 to Cowan (the "Cowan reference"), and the mobile work trailer described in U.S. Pat. No. 9,073,473 to Cramer (the "Cramer reference"). In addition, dust collectors may include Industrial Vacuum Equipment Corporation's Cyclone 20DC Portable Diesel Powered Dust Collector 20000CFM, ARS Recycling Systems, LLC's DC45 45000CFM, Robovent's BNM6818CT200 20000CFM, Entech Industries Ltd's Cyclone 45DC Mobile Dust Collector 45000CFM, and Entech Industries Ltd's Cyclone 20DC Mobile Dust Collector 20000CFM.

BRIEF SUMMARY OF THE INVENTION

Described herein is an air shower system for use with a dust collector having an intake vacuum. The system includes a chamber having at least two enclosing panels. The chamber has an interior and an exterior. At least one vacuum orifice is defined in one of the enclosing panels. The intake vacuum is functionally connected to at least one vacuum orifice. At least one air blade orifice is defined in one of the enclosing panels. At least one air blade is created when the intake vacuum draws air from the exterior of the chamber into the interior of the chamber through the air blade orifice(s). The air blade(s) may be used for dislodging contaminants from an occupant within the chamber. The air blade(s) are preferably at least one stream of air flowing at a faster pace than adjacent air. The air and dislodged contaminants are preferably drawn into the dust collector by the intake vacuum.

The enclosing panels may be frame and surface enclosing panels or may be unified enclosing panels.

The vacuum orifice(s) facilitate(s) at least a functional connection between the dust collector the interior of the chamber. Further, the air blade orifice(s) facilitate(s) at least a functional connection between the exterior of the chamber and the interior of the chamber.

The air blade orifice(s) may be a narrow, elongated air blade orifice(s). A substantially planar air blade is created when the intake vacuum draws air from the exterior of the chamber into the interior of the chamber through a narrow, elongated air blade orifice.

One preferred chamber has at least two enclosing panels including a first side wall and a second side wall. The first side wall is preferably substantially opposite the second side wall. The vacuum orifice(s) is in the first side wall and the air blade orifice(s) is defined in the second side wall.

In one preferred system, the dust collector has an output exhaust for expelling air that remains after the dust collector filters the combined air and contaminants drawn from the chamber. At least one exhaust orifice may be defined in one of the at least two enclosing panels. The output exhaust functionally may be connected to the exhaust orifice(s). At least one air blade is created when the output exhaust pushes air expelled from the dust collector into the interior of the chamber through the at least one of the at least one exhaust orifices. The air blade may be used for dislodging contaminants from an occupant within the chamber.

At least part of the air shower system may be mounted on a mobile trailer associated with the dust collector.

One preferred air shower system for use with a dust collector having an intake vacuum has a chamber with enclosing panels (including at least four side walls, a ceiling, and a floor). The chamber has an interior substantially separated from an exterior by the enclosing panels. At least one vacuum orifice is preferably defined in a first side wall. The intake vacuum is functionally connected to the vacuum orifice(s). The vacuum orifice(s) facilitate(s) at least a functional connection between the dust collector and the interior of the chamber. At least one air blade orifice is preferably defined in a second side wall, the second side wall being opposite the first side wall. The one air blade orifice(s) facilitate(s) at least a functional connection between the exterior of the chamber and the interior of the chamber. At least one air blade is created when the intake vacuum draws air from the exterior of the chamber into the interior of the chamber through the air blade orifice(s). The air blade may be used for dislodging contaminants from an occupant within the chamber.

The subject matter described herein is particularly pointed out and distinctly claimed in the concluding portion of this specification. Objectives, features, combinations, and advantages described and implied herein will be more readily understood upon consideration of the following detailed description of the invention, taken in conjunction with the accompanying drawings.

BRIEF DESCRIPTION OF THE SEVERAL VIEWS OF THE DRAWINGS

The accompanying drawings illustrate various exemplary air showers and/or provide teachings by which the various exemplary air showers are more readily understood.

Figure 1:
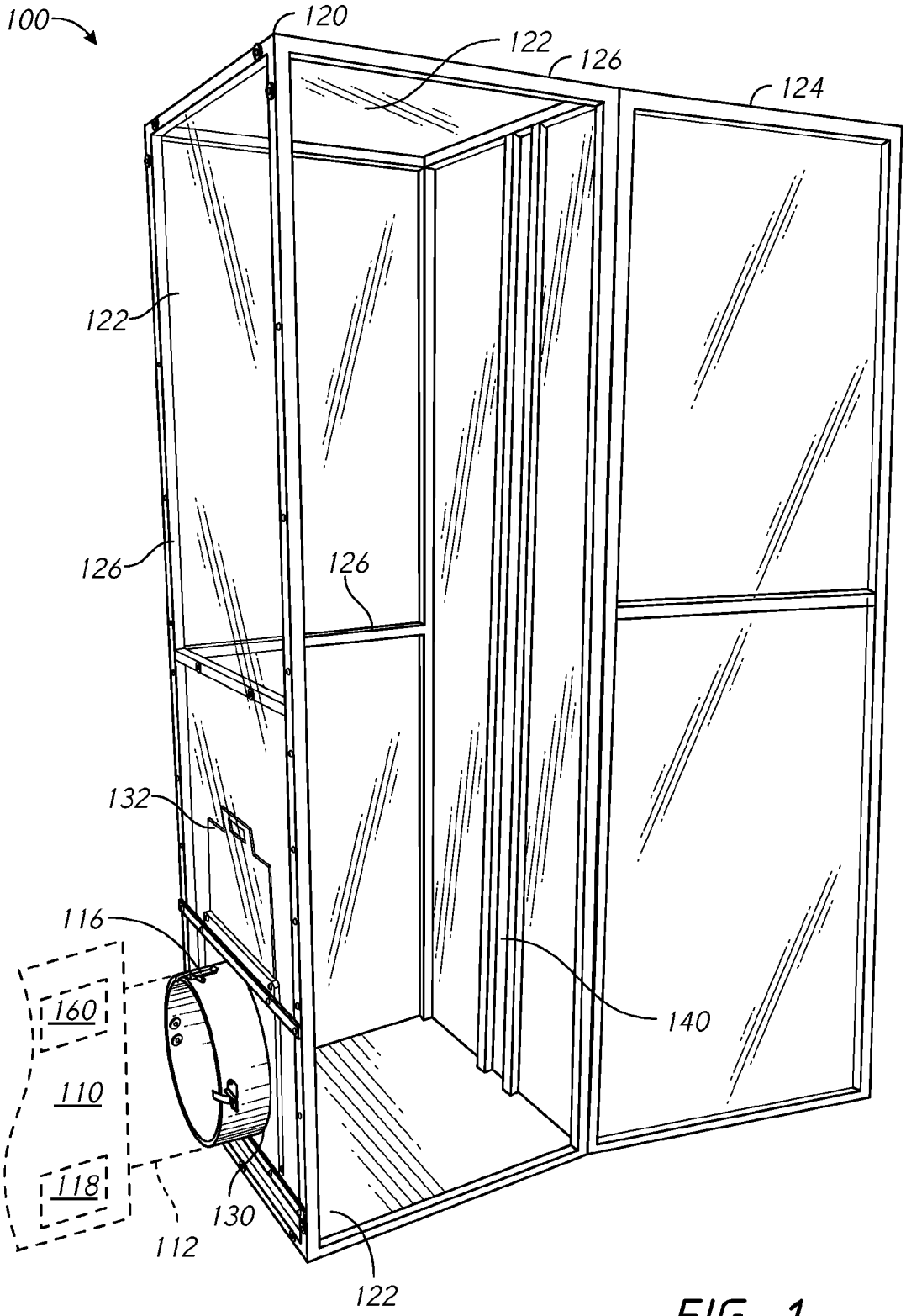
FIG. 1 is a perspective view of a first preferred exemplary air shower with an air blade orifice running vertically top to bottom on the first side and a vacuum orifice on the lower half of the second side.

The drawing figures are not necessarily to scale. Certain features or components herein may be shown in somewhat schematic form and some details of conventional elements may not be shown or described in the interest of clarity and conciseness. The drawing figures are hereby incorporated in and constitute a part of this specification.

DETAILED DESCRIPTION OF THE INVENTION

As set forth, field workers are exposed to contaminants (e.g. silica dust) which can cause health problems through over exposure. While personal protective equipment (PPE) is generally employed to prevent exposure, secondary exposure (for example from residual contaminants on clothing) is sometimes forgotten. An on-site air shower can be employed to remove silica dust from the clothing and bodies of field workers, thus removing the risk of secondary exposure.

Figure 2:
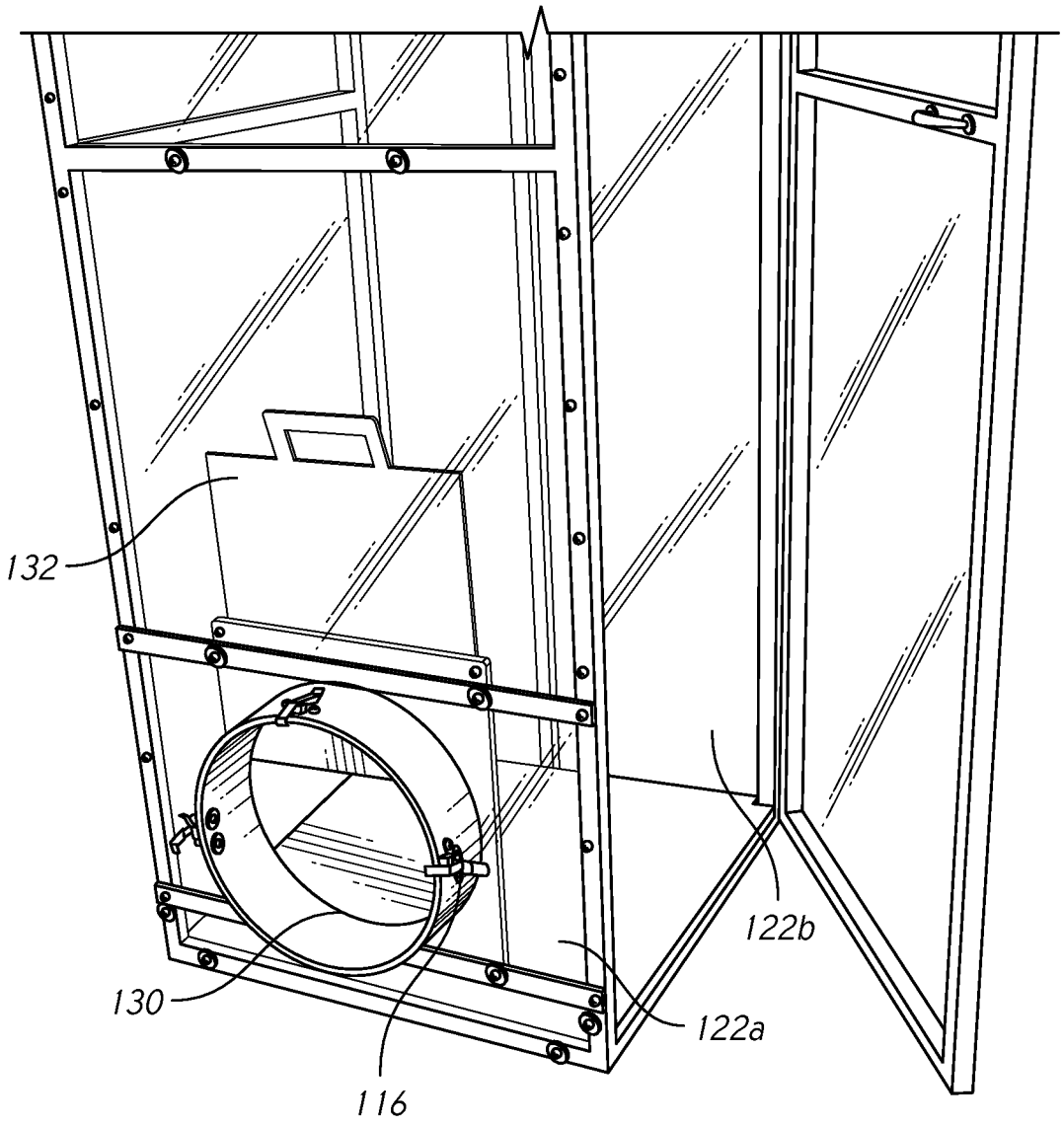
FIG. 2 is an enlarged perspective view of the bottom half of the air shower taken from the side of the air shower having the vacuum orifice.
Figure 3:
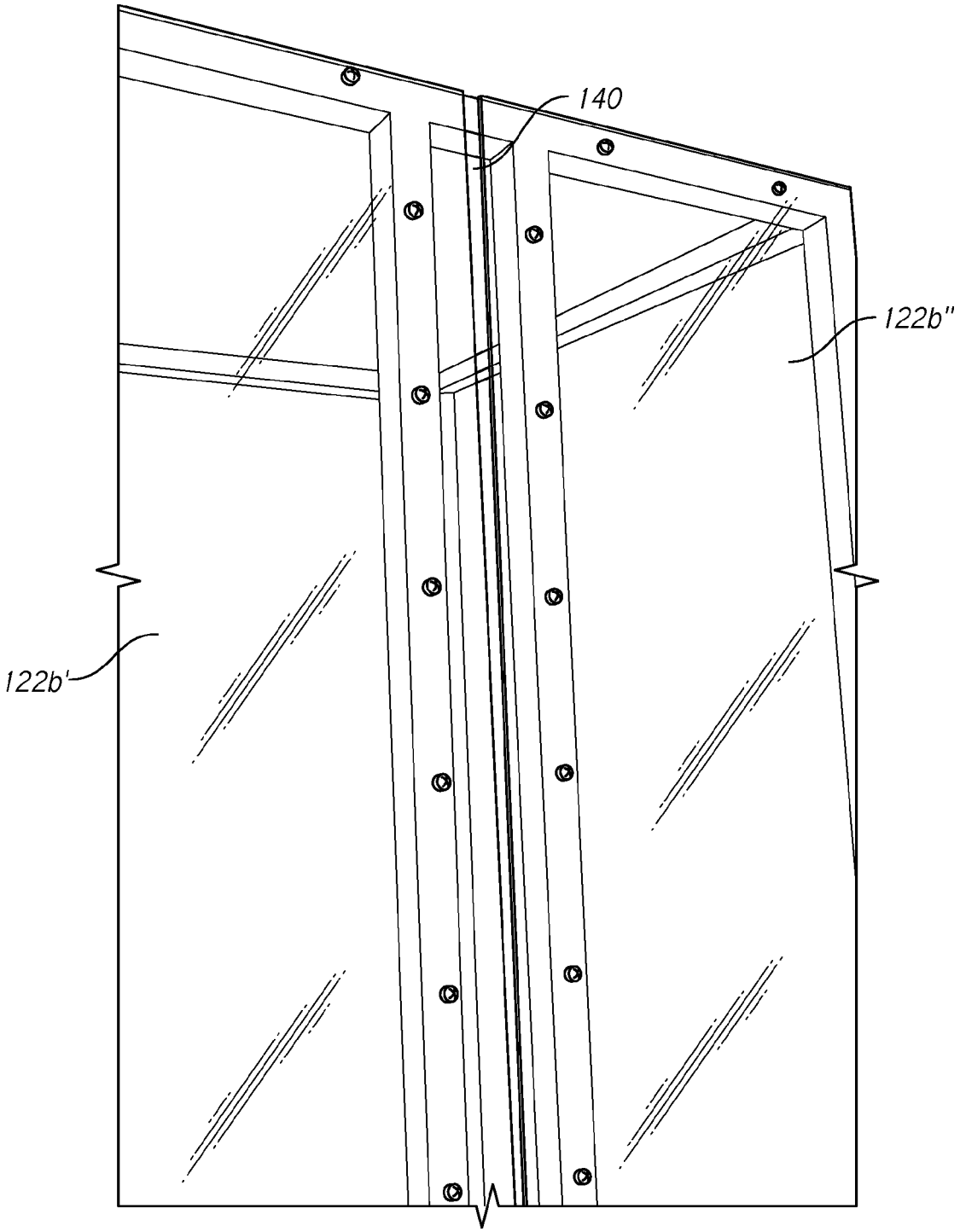
FIG. 3 is an enlarged perspective view of the top half of the air shower taken from the side of the air shower having the air blade orifice.

Air showers 100 described herein are designed to connect to and work with known dust collectors 110. As shown in FIGS. 1-3, the air shower 100 includes chamber 120 with at least one vacuum orifice 130 and at least one air blade orifice 140. The vacuum orifice 130 facilitates (e.g. at least partially provides) the physical and functional connection between a dust collector 110 (which provides a vacuum) and the interior of the chamber 120. The air blade orifice 140 facilitates (e.g. at least partially provides) the physical and functional connection between the exterior of the chamber 120 (from which ambient air can be drawn) and the interior of the chamber 120. An air blade 141 (FIGS. 4 and 5) is formed by the vacuum created by the dust collector 110 drawing or pulling air 102 from the exterior of the chamber 120, through the air blade orifice 140, and into the interior of the chamber 120. As shown in FIGS. 6 and 7, when in use, the vacuum created by the dust collector 110 draws or pulls air 102 and contaminants 104 (e.g. dust) from the interior of the chamber 120 and, indirectly from the exterior of the chamber 120 through the air blade orifice 140. Put another way, air 102 is drawn or pulled from the exterior of the chamber 120 through the air blade orifice 140, pulled around any occupant 106 of the chamber 120 (e.g. a person or an inanimate object), and pulled through the vacuum orifice 130 and into the dust collector 110. As the air 102 from the exterior of the chamber 120 hits and surrounds the occupant 106, contaminants 104 on the occupant 106 are dislodged therefrom. The contaminants 104, along with the air 102, are then pulled into the dust collector 110.

Exemplary air showers may be better understood with reference to the drawings, but these air showers are not intended to be of a limiting nature. The same reference numbers will be used throughout the drawings and description in this document to refer to the same or like parts. The shown shapes and relative dimensions are preferred, but are not meant to be limiting unless specifically claimed, in which case they may limit the scope of that particular claim.

Definitions:

Before describing the air showers and the figures, some of the terminology should be clarified. Please note that the terms and phrases may have additional definitions and/or examples throughout the specification. Where otherwise not specifically defined, words, phrases, and acronyms are given their ordinary meaning in the art. The following paragraphs provide some of the definitions for terms and phrases used herein.

The term "contaminants 104" (examples of which include "silica dust," "dust," "silica," "respirable silica," and "inhalable silica") is used herein to generally include unwanted substances such as respirable and/or inhalable silica dioxide particles. The contaminants 104 may be, for example, generated from the breakdown of "silica sand" (also referred to as "frac sand"). Only a few representative particles of contaminants 104 are shown. The contaminants 104 may not be visible to the human eye or only may be visible when seen in conjunction with many particles of contaminants 104. Alternative contaminants 104 may or may not be made of silica and may include, for example, dirt, dust, skin cells, bacteria, and mold.

The phrase "enclosing panel" is used to refer to the physical structure that makes up the chamber 120. Enclosing panels are the physical side(s) (shown as four sides, but alternatives could have more or fewer sides (e.g. a single conical or cylindrical side)), top (which may be just a point if a teepee shape is used), and/or bottom. A chamber could have as few as two enclosing panels (e.g. an upside-down "ice cream cone" and a bottom to form a teepee-shaped chamber). For convenience, the shown chamber 120 is discussed as having walls (sides), a ceiling (top), and a floor (bottom) as the enclosing panels. The side(s), top, and/or bottom may be made from "frame and surface enclosing panels" as shown in FIGS. 1-3. The frame would generally be a bar or pole of sturdy material (e.g. metal (e.g. steel or aluminum), hard plastic, fiberglass, wood,) and the surface would generally be a lightweight "skin" (e.g. metal (e.g. steel or aluminum), plastic or fiberglass sheeting) that spans the distances between frame elements. Use of a lightweight skin would reduce the overall weight of the chamber 120. Preferably, the air shower 100 could be moved by one individual without assistance. Alternatively, the side(s), top, and/or bottom may be made from "unified enclosing panels" as shown in FIGS. 6 and 7. A unified enclosing panel might be metal, hard plastic, fiberglass, wood, or other sturdy panels known or yet to be discovered that does not need reinforcement. Other types of enclosing panels could take advantage of known or yet to be discovered constructions techniques and apparatus (e.g. slats, building blocks, honeycomb,) known or yet to be discovered could be used to form the chamber as long as the resulting enclosing panels are able to function as described herein. Some chambers might use multiple types of enclosing panels to form the side(s), top, and/or bottom. It should be noted that the specific type of enclosing panels shown in the figures is not meant to be limiting, although claims may provide such limitation. For example, the alternatives shown in FIGS. 9-13 could be constructed using any of the enclosing panels described herein. It should also be noted that although described in terms of individual enclosing panels, the chamber 120 may be made as a whole (e.g. using molding techniques). The phrase "enclosing panels," therefore, would include panels constructed as and/or integrated into a whole. For example, if a cylindrical-shaped chamber was constructed as a whole, it would still have three enclosing panels (an annular side wall panel, a ceiling panel, and a floor panel). It should also be noted that enclosing panels do not have to be flat as they may be, for example, bent, embellished, textured, or have features thereon (e.g. a handle may be molded into the enclosing panel).

The term "orifice" is used to generally define an opening. The orifice may be, for example, a circular opening (e.g. the vacuum orifice 130) or an elongate opening (e.g. the air blade orifice 140). The orifices are defined in the enclosing panels. Although the vertical air blade orifice 140 is shown in most of the drawings, unless specifically claimed, alternative orifices (short slit air blade orifices 142 (FIGS. 10 and 12), small hole air blade orifices 144 (FIG. 11), and/or large hole air blade orifices 146 (FIGS. 12 and 13)) may be substituted. Sizes, shapes, orientations, and quantities of orifices may be adjusted for intended uses, optimization, specific dust collectors 110 (or conduits 112, 114), or other reasons appreciated by those skilled in the art. The orifices should be sized so that the pull of the vacuum increases.

The term "associated" is defined to mean integral or original, retrofitted, attached, connected (including functionally connected), positioned near, and/or accessible by. For example, if an input conduit 112 (or other component) is associated with a dust collector 110 (or other technology), the input conduit 112 may be integral with the dust collector 110, retrofitted into the dust collector 110, removably attached to the dust collector 110, and/or accessible by the dust collector 110.

It should be noted that relative terms (e.g. primary and secondary) are meant to help in the understanding of the technology and are not meant to limit the scope of the invention. Similarly, unless specifically stated otherwise, the terms "first" and "second" are meant solely for purposes of designation and not for order or limitation. For example, the "first preferred exemplary air shower for dust collectors" has no order relationship with the "second preferred exemplary air shower for dust collectors." Another example is that a "first side wall" has no order relationship with a "second side wall."

It should be noted that some terms used in this specification are meant to be relative. For example, the term "top" (used herein in relation to the air shower) is meant to be relative to the term "bottom" (used herein in relation to the air shower). The term "front" is meant to be relative to the term "back," and the term "side" is meant to describe a "face" or "view" that connects the "front" and the "back." Rotation of the system or component that would change the designation might change the terminology, but not the concept.

The terms "may," "might," "can," and "could" are used to indicate alternatives and optional features and only should be construed as a limitation if specifically included in the claims. It should be noted that the various components, features, steps, or embodiments thereof are all "preferred" whether or not it is specifically indicated. Claims not including a specific limitation should not be construed to include that limitation.

Unless specifically stated otherwise, the term "exemplary" is meant to indicate an example, representative, and/or illustration of a type. The term "exemplary" does not necessarily mean the best or most desired of the type. For example, an "exemplary chamber" is just one example of a chamber, but other chambers could be just as desirable.

It should be noted that, unless otherwise specified, the term "or" is used in its nonexclusive form (e.g. "A or B" includes A, B, A and B, or any combination thereof, but it would not have to include all of these possibilities). It should be noted that, unless otherwise specified, "and/or" is used similarly (e.g. "A and/or B" includes A, B, A and B, or any combination thereof, but it would not have to include all of these possibilities). It should be noted that, unless otherwise specified, the terms "includes" and "has" mean "comprises" (e.g. a device that includes, has, contains, or comprises A and B, but optionally may contain C or additional components other than A and B). It should be noted that, unless otherwise specified, the singular forms "a," "an," and "the" refer to one or more than one, unless the context clearly dictates otherwise.

Described herein is an air shower that is connected to a dust collector 110 via a vacuum input conduit 112 (hose). The air shower may be an in-line "air blade" shower. The dust collector 110 may be a mobile dust collector 110. The air shower 100 may be thought of generally as having a chamber 120 that defines an interior 121 of a chamber 120. At least part of one of the enclosing panels (e.g. a wall) of the chamber 120 is or includes a door 124 (which may be the "front" of the chamber 120) or other structure that allows passage of an occupant 106 (or any obstruction such as a person or inanimate object) from the exterior of the chamber 120 to the interior 121 of the chamber 120 (and back again). At least one of the enclosing panels (e.g. a wall) defines at least one vacuum orifice 130 that facilitates the physical and functional connection between a dust collector 110 (which provides a vacuum) and the interior 121 of the chamber 120. At least one of the enclosing panels (e.g. a wall) defines at least one air blade orifice 140 that facilitates the physical and functional connection between the exterior of the chamber 120 (from which ambient air 102 can be drawn) and the interior 121 of the chamber 120.

Dust Collector

While many industrial worksites or fields can benefit from an air shower, the expense of a traditional air shower cannot be justified. But many worksites have a vacuum system (also referred to as a "dust collector 110") already present or that is brought to the site (e.g. mobile dust collector 110) that can be used in conjunction with a chamber 120 to create a relatively inexpensive air shower 100.

A dust collector 110 (which may also be referred to as a "vacuum system") is a known or yet to be discovered system that vacuums (draws, pulls, or sucks) air 102 and contaminants 104. The dust collector's vacuum can also be referred to as an "intake vacuum." The preferred dust collector 110 is mobile. They may be, for example, large trailer mounted dust collector units. A dust collector 110 may include components such as a motor driven blower fan and a large filtration cabinet. The size and power of the vacuum of the dust collector 110 varies, but generally the vacuum power is between 20'000 and 45'000 CFM at 12-14" water. The dust collector is capable of moving very large volumes of air at low pressure. Exemplary dust collectors are discussed in the Background.

Figure 13:
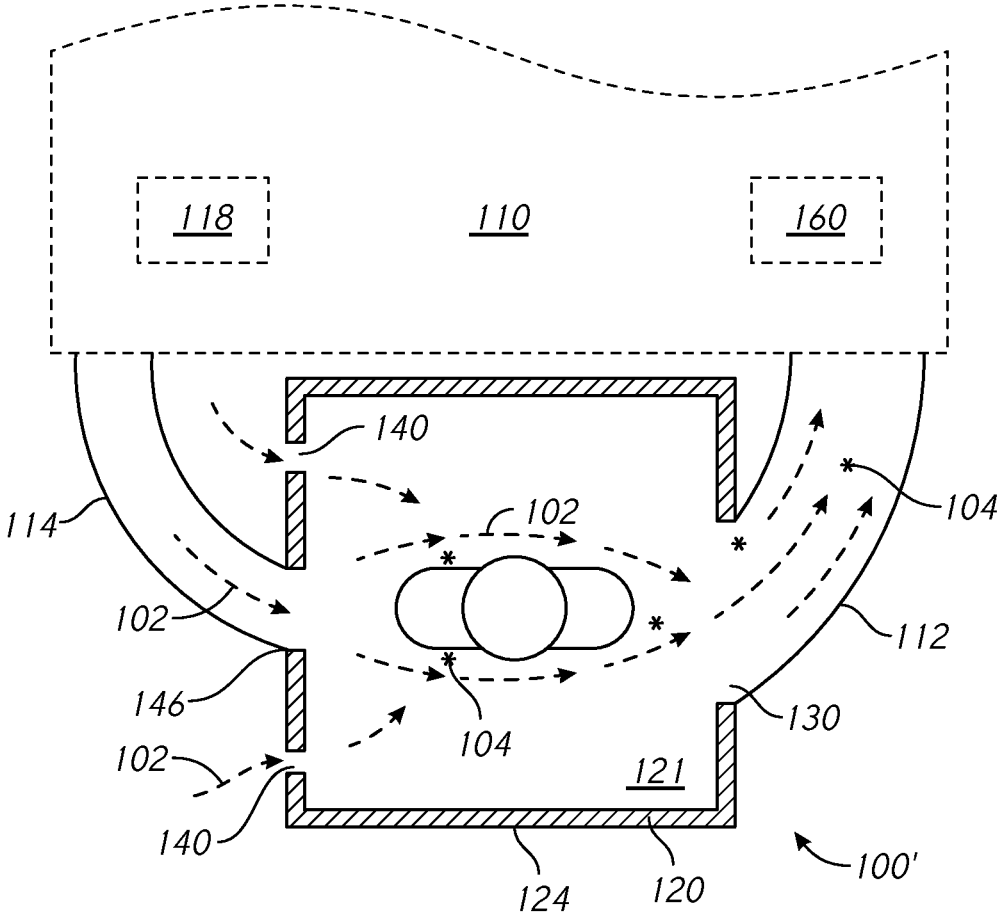
FIG. 13 is a top-down view of a second preferred exemplary air shower having an occupant therein, and showing air flow with air entering the air shower through a dual air blade orifice (including a middle recirculation air blade orifice and two outside slit air blade orifices), circulating around and removing contaminants from the occupant, and exiting the air shower with the contaminants through the vacuum orifice, the dust collector being both the source of exhaust pushed through the middle recirculation air blade orifice and the source of the vacuum (that causes air to enter through the two outside slit air blade orifices and that receives air and contaminants exiting through the vacuum orifice.

A dust collector 110 may have or may be associated with one or more conduits 112, 114 that provide a path or channel into and/or out of the dust collector 110. Conduits 112, 114 may be elongated hoses (or other passageways) that can bend and flex as needed. It should be noted that the conduits 112, 114 may be any length or may be omitted for direct connections. Conduits 112, 114 may be able to hold their shape once properly adjusted. At least one input conduit 112 directs input into the dust collector 110. Output conduits 114 (if any) direct the output (e.g. exhaust) from the dust collector 110. FIG. 1 shows an input conduit 112 that provides a path for air 102 and contaminants 104 to be pulled from the chamber 120 and into the dust collector 110. FIG. 13 shows both an input conduit 112 and an output conduit 114. The output conduit 114 provides a path for air 102 (from which the contaminants 104 have been removed) to be pushed from the dust collector 110 into the chamber 120.

Appropriate connection structure 116 (an example of which is shown in FIGS. 1 and 2) may be used to connect the conduits 112, 114 to the dust collector 110. Preferably the connection structure 116 provides secure, yet removable means for connection (e.g. clasps or clamps) so as to allow the conduits 112, 114 to be used for other purposes. Additional mechanisms (e.g. sealing structure and adapting structure) are not shown, but could be included.

Some industrial systems use compressed air rather than a fan. The air shower system 100 described herein could use compressed air if machinery with compressed air capability is available. Compressed air, however, might necessitate an additional, substantially larger, air tank to supply the demands of the air shower 100.

Chamber

The shown air shower 100 has a chamber 120 having walls, ceiling, and floor enclosing panels that together define the interior 121 of the chamber 120. One of the enclosing panels functions as a door 124 and may be supported by and/or moved (rotated) using appropriate structure (e.g. at least one hinge (not shown)). The shown chamber 120 is shown as a box, roughly 2' wide by 2' long by 7' tall. The actual size and/or shape may be adjusted so that it can accommodate its intended occupant(s) and uses (e.g. rotation within the chamber 120). The dimensions set forth above would be large enough for most people to stand in comfortably and rotate, but larger dimensions might be necessary for certain users.

The chamber 120 has at least one vacuum orifice 130 (out-take from which air is removed from the chamber 120) and at least one air blade orifice 140 (intake from which air enters the chamber 120). The vacuum orifice 130 facilitates the physical and functional connection between a dust collector 110 (which provides a vacuum) and the interior of the chamber 120. The air blade orifice 140 facilitates the physical and functional connection between the exterior of the chamber 120 (from which ambient air can be drawn) and the interior of the chamber 120. The air blade orifice 140 shown in FIGS. 1-7 is a narrow, elongated, vertical, centrally-located air blade orifice 140. Alterative air blade orifices are shown in FIGS. 9-12 and are discussed further herein. The shown vacuum orifice 130 is positioned in the lower portion (generally closer to the ground) of the chamber 120 to help catch settling contaminants 104, as the air blade 140 draws air 102 evenly from top to bottom. Alternatively, the vacuum orifice 130 could be positioned more centrally (about midway between the top and bottom of the chamber 120) or toward the top of the chamber 120. The shown first side wall 122*a* (having at least one vacuum orifice 130 defined therein) is opposite a second side wall 122*b* (having at least one air blade orifice 140 defined therein). It should be noted that alternative versions might have the vacuum orifice(s) 130 and/or the air blade orifice(s) 140 on alternative enclosing panels (adjacent walls, ceiling, and floor). Alternative arrangements of the relationship between the vacuum orifice(s) 130 and/or the air blade orifice(s) 140 may prove useful from a design standpoint (e.g. if the position of the swinging door 124 necessitates an alternative arrangement).

FIGS. 1-3 show the enclosing panels (walls, ceiling, and floor) as a plurality of surfaces 122 supported on a frame structure 126. At least one of the enclosing panels (shown as first side wall and, specifically, a first wall surface 122*a* in FIG. 2) has at least one vacuum orifice 130 (e.g. a cutout with an approximately 6 inch to 20 inch diameter) defined therein. At least one of the enclosing panels (shown as second side wall and, specifically, a second wall surface 122*b* in FIG. 2, opposite the first wall surface 122*a*) has at least one air blade orifice 140 (e.g. 4 foot to 7 foot slit) defined therein. The surfaces 122 are shown as being supported on (and preferably at least partially attached to) a frame 126 (shown in detail in FIG. 8).

Figure 8:
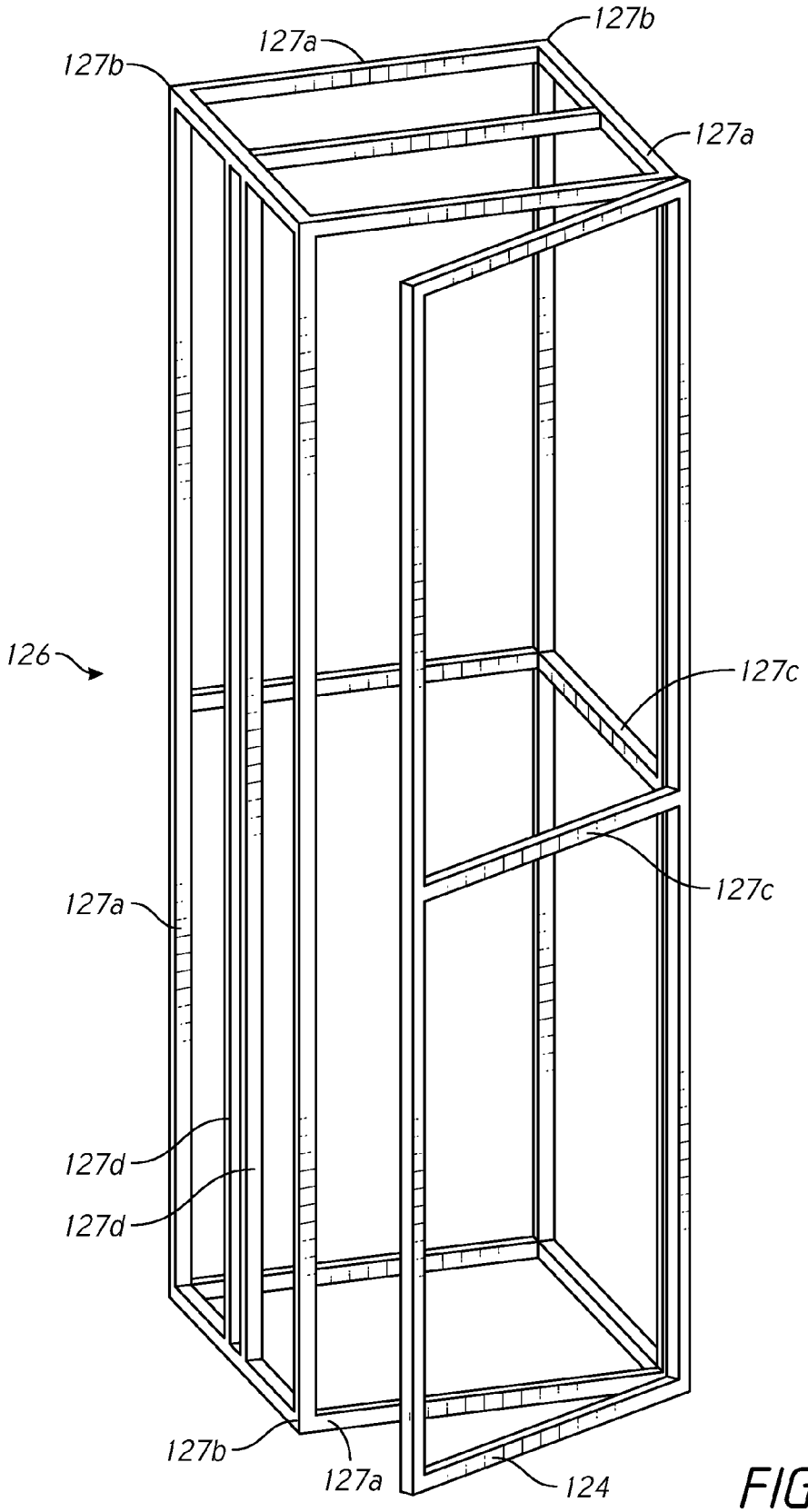
FIG. 8 is a perspective view of an exemplary framework of an exemplary air shower with a vertical air blade orifice.

The frame 126 (as shown in FIG. 8) is shown as including or may include peripheral support structure (e.g. longitudinal and latitudinal bars 127*a* spanning the distance between corners 127*b*), stabilizing structure (e.g. longitudinal bars 127*c* spanning the distance between longitudinal peripheral support structure and/or latitudinal bars spanning the distance between latitudinal peripheral support structure), and/or orifice defining structure 127*d* (e.g. structure used to define orifices such as the vacuum orifice(s) 130 and/or the air blade orifice(s) 140). Although shown as an interior frame, the frame could be an exterior frame (exoskeleton).

The exemplary shown chamber 120 of the air shower 100 of FIGS. 1-3 includes surfaces 122 manufactured from transparent material. Such transparent material could have advantages including safety (e.g. if a problem occurs within the chamber 120) and comfort (e.g. to prevent a feeling of claustrophobia). Some or all of the surface material, however, may be opaque or solid. If opaque material is used, windows and/or artificial lighting may be provided for comfort and to allow the user to operate the controls. (The walls shown in FIGS. 4-5 could also be transparent or opaque.)

It should be noted that some or all of the frame and surface enclosing panels (shown as the surfaces 122 and the frame 126) may be replaced with unified enclosing panels as shown in FIGS. 4-7. For example, the first side wall and second side wall may be unified enclosing panels. The unified enclosing panel(s) would have sufficient strength and rigidity to function in a manner similar to the frame and surface enclosing panel(s). As with the frame and surface enclosing panels, at least one of the wall unified enclosing panels (the first side wall) has at least one vacuum orifice 130 defined therein and at least one of the unified enclosing panels (shown as the second side wall opposite the first side wall) has at least one air blade orifice 140 defined therein.

Air Blade and Air Flow

An air blade is a stream of air flowing at a faster pace than adjacent air. A preferred air blade is powerful enough to dislodge contaminants 104 from an obstruction 106.

An exemplary air blade 141 (FIGS. 4 and 5) is formed by the vacuum created by the dust collector 110 drawing or pulling air 102 from the exterior of the chamber 120, through the air blade orifice 140, and into the interior of the chamber 120. An air blade 141 formed by pulling air through the shown elongated vertical air blade orifice 140, without obstruction, would have a relatively planar shape. (The "arrow" portion of the shown air blade 141 is meant to show direction.) In use, however, there would be an obstruction 106 (e.g. an occupant rotating inside the chamber). As shown in FIGS. 6 and 7, the air blade 141, after hitting the obstruction 106, air 102 would wrap around the obstruction 106, and eventually be drawn into the dust collector 110 along with contaminants 104 that the air blade 141 had dislodged.

At least one air blade orifice 140 is formed in an enclosing panel of the chamber 120. In a frame and surface enclosing panel construction, multiple partial surfaces 122*b*' and 122*b*" (FIG. 3) and the frame structure 126 (e.g. orifice defining structure 127*d* as shown in FIG. 8) are used to define the blade orifice 140. Put another way, the air blade orifice 140 may be a gap formed between two distinct enclosing partial panels (e.g. surfaces 122*b*' and 122*b*"). Alternatively, the air blade orifice 140 may be removed from (e.g. cut, drilled, or punched) from a solid surface. For example, an air blade orifice 140 may be a slit or a hole in a surface 122 (or in a unified enclosing panel). The material surrounding the slit/hole should be sufficiently rigid to prevent the surface 122 (or unified enclosing panel) from bending in response to the pressure. Even a small variance in the positions on the sides of the air blade orifice 140 and the air blade 141 may "point" in an unintended direction (e.g. diagonally) rather than the intended direction (e.g. forward) and lose functionality.

Figure 4:
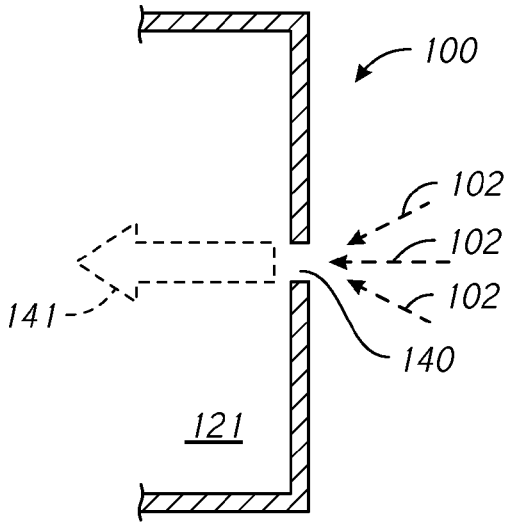
FIG. 4 is a top view of a partial air shower with unimpeded air flow created by a vertical air blade orifice.
Figure 5:
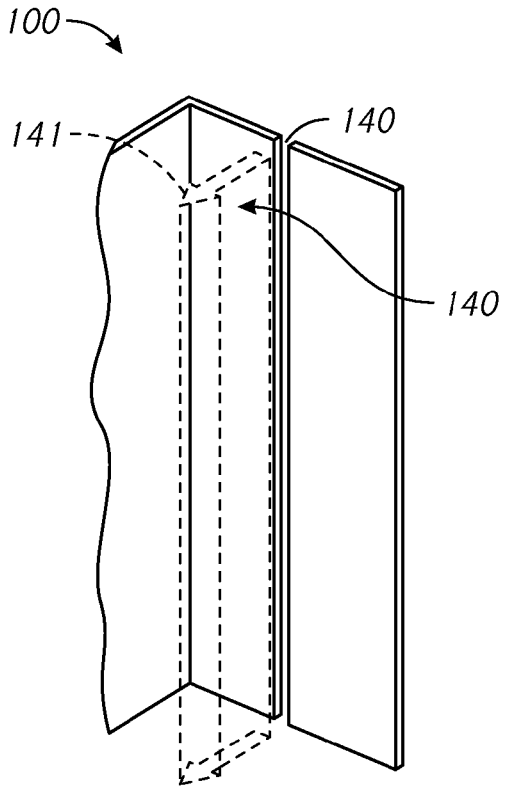
FIG. 5 is a perspective view of a partial air shower with unimpeded air flow created by a vertical air blade orifice.
Figure 6:
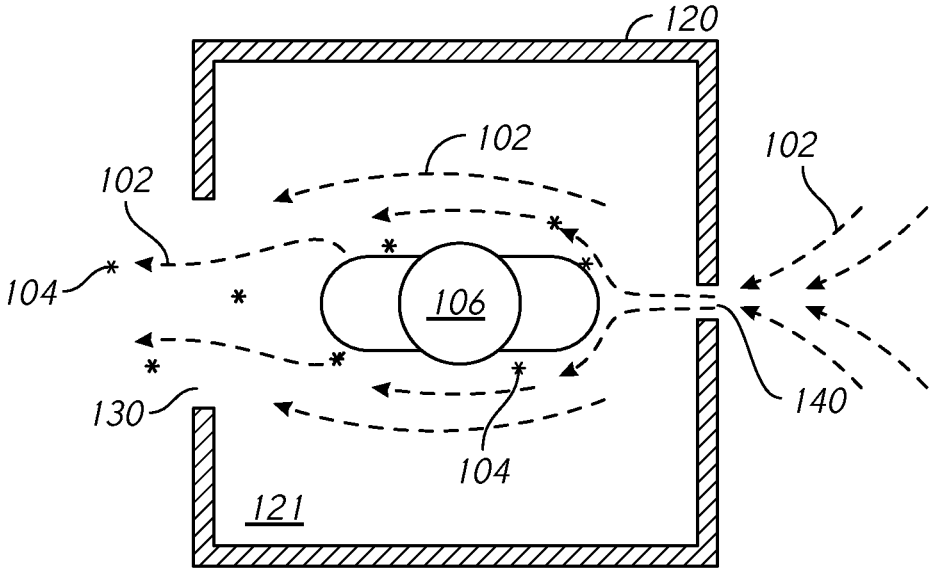
FIG. 6 is a top-down view of an air shower having an occupant in a first position therein, and showing air flow with air entering the air shower through the air blade orifice, circulating around and removing contaminants from the occupant, and exiting the air shower with the contaminants through the vacuum orifice.
Figure 7:
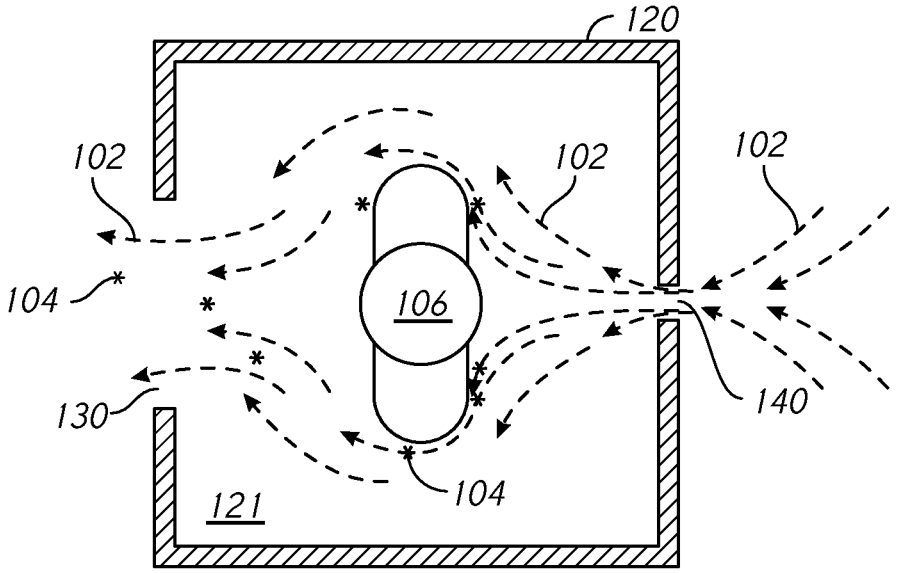
FIG. 7 is a top-down view of an air shower having an occupant in a second position therein, and showing air flow with air entering the air shower through the air blade orifice, circulating around and removing contaminants from the occupant, and exiting the air shower with the contaminants through the vacuum orifice.
Figure 9:
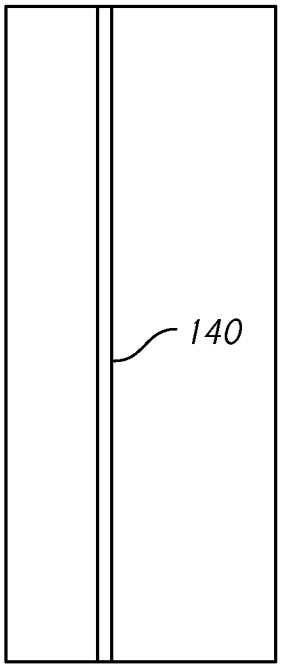
FIG. 9 is a straight on view of a side wall enclosing panel having a single vertical air blade orifice slightly offset from center.
Figure 10:
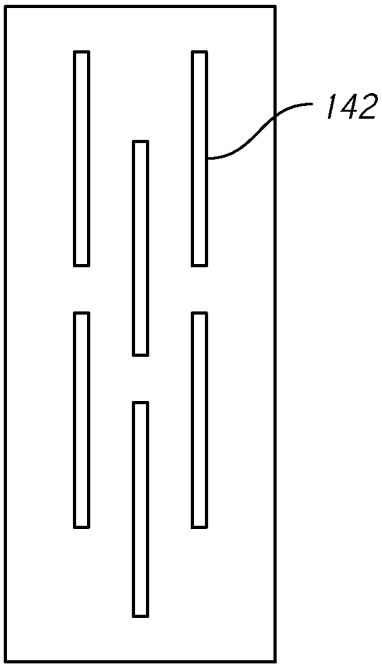
FIG. 10 is a straight on view of a side wall enclosing panel having a pattern air blade orifice, the pattern being shown as six slit air blade orifices grouped into three columns of two slits, the middle column being staggered from the outside columns.
Figure 11:
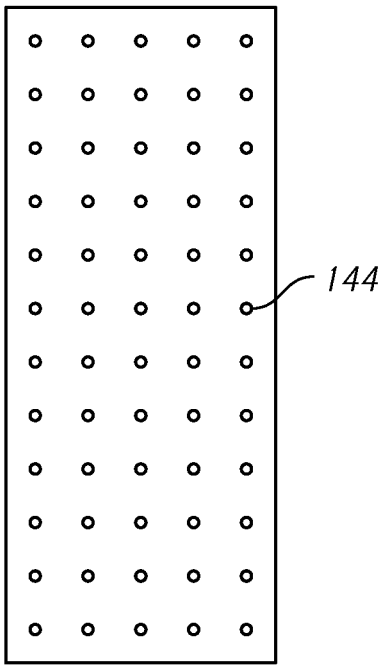
FIG. 11 is a straight on view of a side wall enclosing panel having a grid air blade orifice, the grid air blade orifice having multiple small hole air blade orifices covering the entire surface of one side of the air shower.
Figure 12:
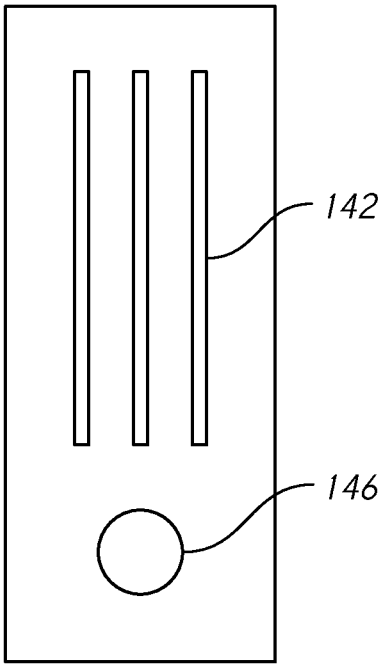
FIG. 12 is a straight on view of a side wall enclosing panel having a dual air blade orifice, the top part of the dual air blade orifice including three evenly spaced slit air blade orifices running from just below the top of the side wall to approximately two-thirds of the way down the side wall, and the bottom part of the dual air blade orifice including a recirculation orifice (shown as a large hole air blade orifice) centered in the lower third of the side wall through which recirculated air from the dust collector can be forced.

FIG. 9 shows a single vertical air blade orifice 140 on a side wall enclosing panel at least similar to the air blade orifice 140 shown in FIGS. 1-7, although the vertical air blade orifice 140 in FIG. 9 is offset from center. In addition to the single vertical air blade orifice 140, air blade orifices might be short slit air blade orifices 142 (FIGS. 10 and 12), small hole air blade orifices 144 (FIG. 11), and/or large hole air blade orifices 146 (FIGS. 12 and 13). These are only exemplary types of orifices and other shapes, sizes, and orientations of orifices are possible. These orifices may be arranged in many ways. FIG. 9 shows a side wall enclosing panel having a single vertical air blade orifice 140 that is slightly offset from center. FIG. 10 shows a side wall enclosing panel having a pattern of air blade orifices; the pattern being shown as six short slit air blade orifices 142 grouped into three columns of two slits, the middle column being staggered from the outside columns. FIG. 11 shows a side wall enclosing panel having a grid pattern of air blade orifices; the grid air blade orifice having multiple small hole air blade orifices 144 covering the entire surface of one side of the air shower. FIG. 12 shows a side wall enclosing panel having a dual pattern air blade orifice. The top part of the dual pattern air blade orifice includes three evenly spaced slit air blade orifices 142 running from just below the top of the side wall to approximately two-thirds of the way down the side wall. The bottom part of the dual pattern air blade orifice includes a recirculation orifice (shown as a large hole air blade orifice 146) centered in the lower third of the side wall through which recirculated air from the dust collector can be forced. The side wall enclosing panel shown in FIG. 13 has a central large hole air blade orifice 146 positioned between two slit air blade orifices 140 or 142. These patterns are meant to be exemplary and not limiting. The air blades emitted from the different air blade orifices would, of course, have a different "shape" than air blades of different shapes, sizes, orientations, and patterns and the air blade 141 shown in FIGS. 4 and 5 is only meant to assist in the visualization of the air blade. The ideal shape(s), size(s), orientation(s), and/or pattern(s) of the air blades would be determined based on factors including, but not limited to, intended use, the specific dust collector to be used, and other factors known or yet to be discovered. The shown air blade orifices 140, for example, may be approximately 0.050" wide. Experimentally, widths between 0.125" and 0.375" have been effective at generating higher volumes with relatively low pressure. This was sufficient for the cleaning process and presented no risk to the user.

When the air shower system 100 of FIGS. 1-7 is used, the vacuum created by the dust collector 110 draws or pulls air 102 and contaminants 104 (e.g. dust) from the interior of the chamber 120 and, indirectly, draws or pulls air 102 from the exterior of the chamber 120 through the air blade orifice 140. Put another way, air 102 is drawn from the exterior of the chamber 120 through the air blade orifice 140, drawn around any occupant 106 of the chamber 120 (e.g. a person or an inanimate object), and drawn through the vacuum orifice 130 and into the dust collector 110 (possibly via an input conduit 112). As the air 102 from the exterior of the chamber 120 hits and surrounds the occupant 106, contaminants 104 on the occupant 106 are dislodged therefrom. The contaminants 104, along with the air 102, are then drawn into the dust collector 110 (possibly via an input conduit 112).

FIG. 13 shows an alternative air shower system 100' having an output conduit 114 that directs the output (e.g. "exhaust" or "output exhaust") from the dust collector 110 through an air blade orifice 146 (which, when used in this capacity, can also be referred to as an exhaust orifice) and into the chamber 120. The exhaust is preferably the air 102 that remains after the dust collector 110 filters (via filter 118) the combined air 102 and contaminants 104 that are drawn from the chamber 120. When the air shower system 100' of FIG. 13 is used, the vacuum created by the dust collector 110 draws or pulls air 102 and contaminants 104 (e.g. dust) from the interior of the chamber 120. The dust collector 110 filters the combined air 102 and contaminants 104. The air 102 remaining after the filtration is sent as exhaust back into the chamber 120. The force of the exhaust adds to the vacuum so that the air 102 exhausted into the chamber 120 also forms an air blade. Put another way, air 102 is drawn from the exterior of the chamber 120 through the air blade orifice 140 and pushed from the exhaust of the dust collector 110, drawn around any occupant 106 of the chamber 120 (e.g. a person or an inanimate object), and drawn through the vacuum orifice 130 and into the dust collector 110 (possibly via an input conduit 112). As the air 102 from the exterior of the chamber 120 hits and surrounds the occupant 106, contaminants 104 on the occupant 106 are dislodged therefrom. The contaminants 104, along with the air 102, are then drawn into the dust collector 110 (possibly via an input conduit 112) where they are filtered and expelled as exhaust.

The air shower system 100' of FIG. 13 would drive air 102 through an air blade as an alternative method for generating air pressure. This air shower system 100' has the potential to impact the overall efficiency of the dust collector 110 because it creates a pressure buildup after the blower fan. To avoid this, the additional air should comprise only part of the total volume of exhausted air from the dust collector 110, thereby allowing the air pressure to vent to the ambient air. The air 102 from exhaust of the air shower system 100' of FIG. 13 should be clean as filters 118 tend to operate at 99.8% efficiency. Should a tear form in a filter 118, however, the possibility exists that the user would be exposed to additional contaminants 104. A standard requirement to wear respiratory PPE should resolve this issue.

Another alternative air shower system (not shown) would use only parts of the system 101' shown in FIG. 11 that are concerned with inputting the output (e.g. exhaust) from the dust collector 110 through an air blade orifice 146 and into the chamber 120. The vacuum created by the dust collector 110 would not be used.

Yet another alternative air shower system (not shown) would allow selective use of either or both an air blade created by the output (e.g. exhaust) from the dust collector 110 and/or the air blade created by the vacuum created by the dust collector 110. Appropriate switches and mechanical, electrical, control mechanisms (e.g. computer hardware and/or software) would be provided to allow manual and/or automatic selection.

Mounting and Installation

Figure 14:
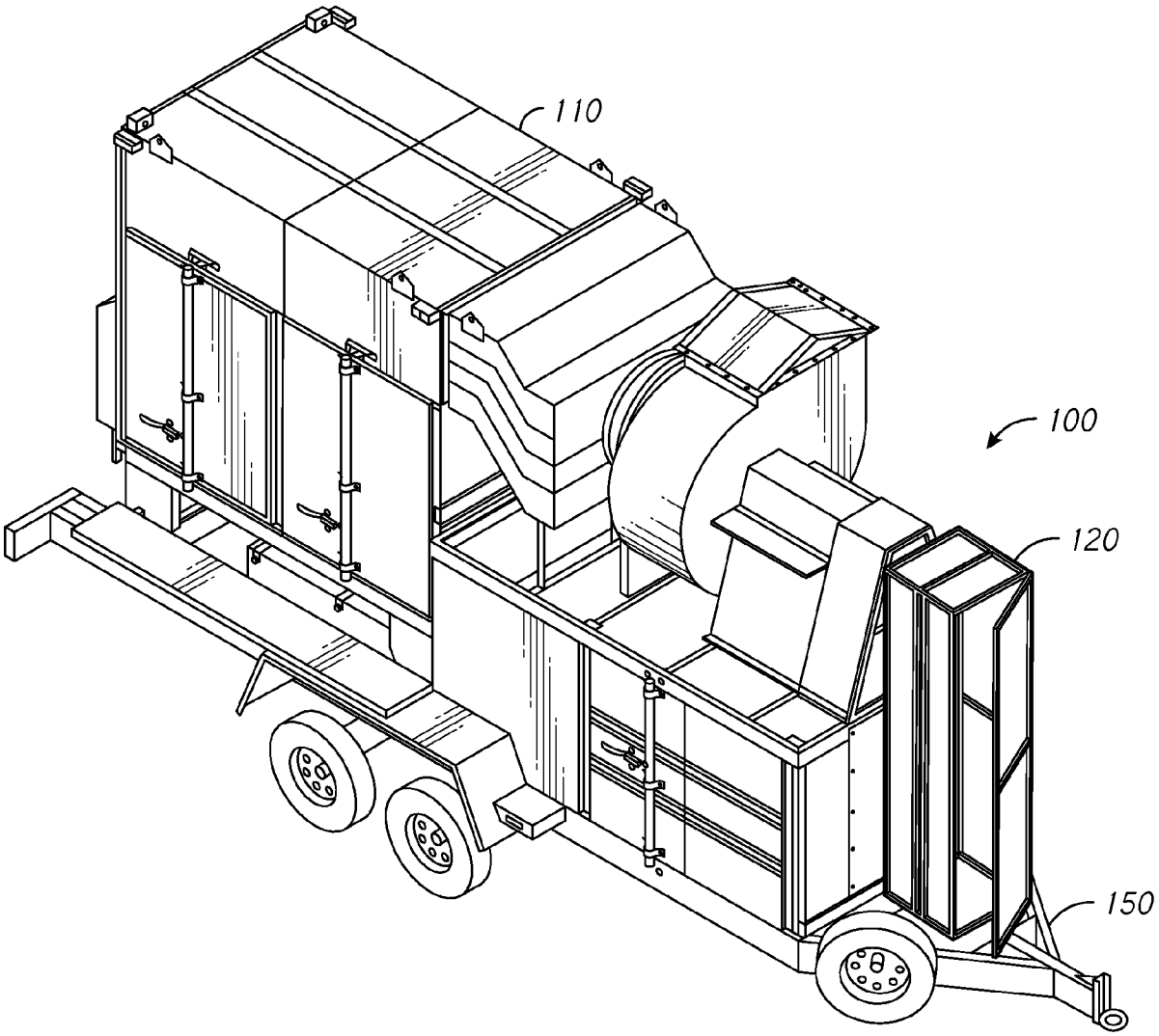
FIG. 14 is a perspective view of an exemplary air shower mounted to the front of an exemplary dust collector trailer.

FIG. 14 shows an exemplary mounting of an air shower system 100. For many known vacuum trailers 150, the front of the trailer 150 is an ideal position on which to mount the air shower system 100 such that it does not interfere with regular conduit (hose) connections (e.g. those conduits needed for use of the dust collector 110 for its primary purpose). If mounted on the front of the trailer 150, the enclosing panel(s) (especially the panel facing forward) must be protected from damage by rocks and other debris kicked up on the highway. Appropriate precautions (e.g. shields, strengthening) could be provided for any position. Whatever position is used for mounting, the conduit(s) 112, 114 should be able to reach the vacuum orifice(s) 130 and/or air blade orifice(s) 140.

The mounting may be permanent or temporary (e.g. attachable/detachable). Conduits 112, 114 (which may be associated with the dust collector 110, the air shower system 100, or completely separate) may be attached permanently or may be temporary (e.g. attachable/detachable). If the mounting is permanent, care should be taken that the door 124 is not blocked so that it can open sufficiently for occupants to enter and exit the chamber 120. Although not shown, multiple air shower systems 100 can also be mounted.

Alternative Systems and Optional Features

The following features may be incorporated in any of the above described air shower systems.

Temperature Control: The temperature control apparatus 160 (which may be integral or otherwise associated with the dust collector 110, or its own component) may be included in any of the systems described herein. The temperature control apparatus 160 may be a heater providing the ability to heat the air entering and/or within the chamber 120. The temperature control apparatus 160 may be an air conditioner providing the ability to cool the air entering and/or within the chamber 120. For example, if the air temperature should drop to a level unsuitable for humans to be exposed to in higher velocities, then an air heater could be used. Alternatively, moving air 102 through the engine compartment or using the exhaust system or other existing heat source would work. In all likelihood, listed operating temperatures for the system are preferable, as overly hot air 102 could present a similar problem. Another example is that if the air shower provided cooled air, it could relieve thermal stress suffered by field workers.

Vacuum Orifice Barrier: A barrier 132 may be provided that allows a mechanical block of the vacuum orifice 130. The barrier 132 may swivel, pivot, slide, or otherwise move to prevent the vacuum created by the dust collector 110. The barrier may be automated or manual. The barrier 132 may function as a valve that allows the chamber 120 to be turned "on" by removing the barrier 132 and turned "off" by closing the barrier 132. This barrier could be mounted on the inside of the chamber, the outside of the chamber, or in both locations.

Emergency Shutdown Button: Should the primary valve fail or for any other reason an emergency is deemed to occur, a secondary or emergency shutdown button (not shown) could be engaged. The emergency shutdown button could cause the barrier 132 to block the vacuum orifice 130.

Pressure Relief Valve: Though technically almost impossible, should a dangerous vacuum pressure buildup occur, a relief valve (not shown) in the chamber 130 could allow air in to negate the pressure.

Pressurized Wand: The addition of a wand or nozzle attached to a second pressurized air source could be used to provide additional power for removing contaminants 104. The nozzle could be fixed in a specific location, or attached to a hose allowing the user to determine where the air flow was directed.

Method of Use

To use a system described herein, the user enters the air shower chamber 120 through a door 124, and closes it behind him. The worker should be wearing all necessary PPE including, for example, a full-face mask respirator, and ear protection.

The vacuum is necessarily already on and working. Alternatively, the user can open a valve (e.g. lift the barrier 132) that connects the air shower chamber 120 to the vacuum of the dust collector 110. This valve can open slowly over a period of a couple seconds if the user finds it better to not have a sudden pressure drop.

The user 106 then rotates slowly, allowing the air blade 141 to remove the contaminants 104 from his clothes and exposed skin.

If the contaminants 104 have been ground in to the clothing fibers, the user can pat himself down to effectively release the containments 104 from his clothing. The user should also be careful to lift up his collar to remove any trapped contaminants 104 therein.

Once the user is satisfied that he has removed most of the contaminants 104, he can shut the valve (e.g. lower the barrier 132), thereby stopping the vacuum (and thereby stopping the air flow) and allowing him to exit the chamber 120.

Advantages and Distinction from Known Systems

One of the advantages of the air shower 100 described herein is that it does not require any air input or systems designed to provide air input (e.g. a fan or compressed air). Known air showers operate as "push" systems in which air 102 is forced towards a person (or other obstruction) in an enclosure. The air shower described herein operates as a "pull" system, using vacuum to pull the ambient air 102 (from outside the chamber 120) through at least one air blade orifice 140 to form an air blade 141 within the interior 121 of the chamber 120. Another advantage of the air shower 100 described herein is that an existing system (e.g. the dust collector 110) usually found on site can be used to create the vacuum. Put another way, the dust collector 110 (which is probably on site) provides the drive system, air system, and/or power system.

U.S. Pat. No. 4,765,352 to Strieter (the "352 Strieter reference") and U.S. Pat. No. 5,558,112 to Strieter (the "'112 Strieter reference") (together described as the "Strieter references"), are directed to portable isolation enclosures that can be used to clean contaminated environments. The Strieter references teach portable isolation enclosures that can be used to safely remove material from the ceilings or walls of a building structure while isolating the portion of the walls from which the material is being removed. The top or sides of the portable isolation enclosure can be removed to allow the user inside the portable isolation enclosure to access the portion of the ceiling or wall against which the open top or side is positioned. A vacuum filter system draws air from outside the booth into the interior of the booth, filtering the air along with any airborne contaminants, and then exhausting clean air to the environment. There are several significant differences between the system of the Strieter references and the system described herein. One significant difference is that the Strieter system is designed to pull both air and contaminants from outside the portable isolation enclosure into and through the portable isolation enclosure. The system described herein pulls air from outside the chamber. The contaminants are on the user who is within the chamber. Another significant difference is that the vacuum of the Strieter system cannot create an air blade when the entire surface (top or side) is removed. Instead, the vacuum of the Strieter system produces a relatively even flow.

It is to be understood that the inventions, examples, and embodiments described herein are not limited to particularly exemplified materials, methods, and/or structures. It is to be understood that the inventions, examples, and embodiments described herein are to be considered preferred inventions, examples, and embodiments whether specifically identified as such or not. The shown inventions, examples, and embodiments are preferred, but are not meant to be limiting unless specifically claimed, in which case they may limit the scope of that particular claim.

All references (including, but not limited to, foreign and/or domestic publications, patents, and patent applications) cited herein, whether supra or infra, are hereby incorporated by reference in their entirety.

The terms and expressions that have been employed in the foregoing specification are used as terms of description and not of limitation, and are not intended to exclude equivalents of the features shown and described. While the above is a complete description of selected embodiments of the present invention, it is possible to practice the invention using various alternatives, modifications, adaptations, variations, and/or combinations and their equivalents. It will be appreciated by those of ordinary skill in the art that any arrangement that is calculated to achieve the same purpose may be substituted for the specific embodiment shown. It is also to be understood that the following claims are intended to cover all of the generic and specific features of the invention herein described and all statements of the scope of the invention that, as a matter of language, might be said to fall therebetween.

What is claimed is:

1. An air shower system for use with a dust collector having an intake vacuum, said system comprising:

(a) a chamber having at least two enclosing panels, said chamber having an interior and an exterior;

(b) at least one vacuum orifice defined in one of said at least two enclosing panels, said intake vacuum functionally connectable to at least one of said at least one vacuum orifices; and (c) at least one air blade orifice defined in at least one of said at least two enclosing panels, said at least one air blade orifice being at least one narrow, elongated air blade orifice;

(d) wherein at least one substantially planar air blade is created when said intake vacuum draws air from said exterior of said chamber into said interior of said chamber through said at least narrow, elongated one air blade orifice, said at least one substantially planar air blade for dislodging contaminants from an occupant within said chamber.

2. The system of claim 1, said at least one air blade being at least one stream of air flowing at a faster pace than adjacent air.

3. The system of claim 1, said air and dislodged contaminants being drawn into said dust collector by said intake vacuum.

4. The system of claim 1, said at least two enclosing panels being at least two frame and surface enclosing panels.

5. The system of claim 1, said at least two enclosing panels being at least two unified enclosing panels.

6. The system of claim 1, further comprising:

(a) said at least one vacuum orifice facilitating at least a functional connection between said dust collector and said interior of said chamber; and (b) said at least one air blade orifice facilitating at least a functional connection between said exterior of said chamber and said interior of the chamber.

7. The system of claim 1, said chamber having at least two enclosing panels including a first side wall and a second side wall, said first side wall being substantially opposite said second side wall, said at least one vacuum orifice defined in said first side wall, and said at least one air blade orifice defined in said second side wall.

8. The system of claim 1, wherein at least part of said air shower system is mounted on a mobile trailer associated with said dust collector.

9. The system of claim 1, said at least one air blade orifice being a plurality of air blade orifices.

10. The system of claim 1, said at least one vacuum orifice positioned in a lower portion of said one of said at least two enclosing panels.

11. The system of claim 1, said at least one air blade orifice being a plurality of air blade orifices, said at least one vacuum orifice positioned in a lower portion of said one of said at least two enclosing panels.

12. The system of claim 1, said intake vacuum drawing air at a vacuum power of at least 20'000 CFM at 12-14" water.

13. The system of claim 1, said dust collector capable of moving very large volumes of air at low pressure.

14. The system of claim 1, said at least two enclosing panels surrounding said at least one vacuum orifice being sufficiently rigid to prevent said at least two enclosing panels from bending when said intake vacuum draws air.

15. An air shower system for use with a dust collector having an intake vacuum, said system comprising:

(a) a chamber having at least two enclosing panels, said chamber having an interior and an exterior;

(b) at least one vacuum orifice defined in one of said at least two enclosing panels, said intake vacuum functionally connectable to at least one of said at least one vacuum orifices;

(c) at least one air blade orifice defined in at least one of said at least two enclosing panels;

(d) said dust collector having an output exhaust for expelling air that remains after said dust collector filters the combined air and contaminants drawn from said chamber;

(e) at least one exhaust orifice defined in one of said at least two enclosing panels; and (f) said output exhaust functionally connected to at least one of said at least one exhaust orifices;

(g) wherein at least one air blade is creatable when said intake vacuum draws air from said exterior of said chamber into said interior of said chamber through said at least one air blade orifice, said at least one air blade for dislodging contaminants from an occupant within said chamber;

(h) wherein at least one air blade is created when said output exhaust pushes air expelled from said dust collector into said interior of said chamber through said at least one of said at least one exhaust orifices, said air blade for dislodging contaminants from an occupant within said chamber.

16. An air shower system for use with a dust collector having an intake vacuum, said system comprising:

(a) a chamber having enclosing panels including at least four side walls, a ceiling, and a floor, said chamber having an interior substantially separated from an exterior by said enclosing panels;

(b) at least one vacuum orifice defined in a first side wall, said intake vacuum functionally connected to at least one of said at least one vacuum orifices, and said at least one vacuum orifice facilitating at least a functional connection between said dust collector said interior of said chamber; and (c) at least one air blade orifice defined in a second side wall, said second side wall being opposite said first side wall, and said at least one air blade orifice facilitating at least a functional connection between said exterior of said chamber and said interior of said chamber, said at least one air blade orifice being at least one narrow, elongated air blade orifice;

(d) wherein at least one substantially planar air blade is created when said intake vacuum draws air from said exterior of said chamber into said interior of said chamber through said at least one narrow, elongated air blade orifice, said at least one substantially planar air blade for dislodging contaminants from an occupant within said chamber.

17. The system of claim 16, said at least one air blade being at least one stream of air flowing at a faster pace than adjacent air.

18. The system of claim 16, said air and dislodged contaminants being drawn into said dust collector by said intake vacuum.

19. The system of claim 16, said enclosing panels being frame and surface enclosing panels.

20. The system of claim 16, said enclosing panels being unified enclosing panels.

21. The system of claim 16, wherein at least part of said air shower system is mounted on a mobile trailer associated with said dust collector.

22. The system of claim 16, said at least one air blade orifice being a plurality of air blade orifices.

23. The system of claim 16, said at least one vacuum orifice positioned in a lower portion of said first side wall.

24. The system of claim 16, said at least one air blade orifice being a plurality of air blade orifices, said at least one vacuum orifice positioned in a lower portion of said first side wall.

25. The system of claim 16, said intake vacuum drawing air at a vacuum power of at least 20'000 CFM at 12-14" water.

26. The system of claim 16, said dust collector capable of moving very large volumes of air at low pressure.

27. The system of claim 16, said at least two enclosing panels surrounding said at least one vacuum orifice being sufficiently rigid to prevent said at least two enclosing panels from bending when said intake vacuum draws air.

28. An air shower system for use with a dust collector having an intake vacuum, said system comprising:

(a) a chamber having enclosing panels including at least four side walls, a ceiling, and a floor, said chamber having an interior substantially separated from an exterior by said enclosing panels;

(b) at least one vacuum orifice defined in a first side wall, said intake vacuum functionally connected to at least one of said at least one vacuum orifices, and said at least one vacuum orifice facilitating at least a functional connection between said dust collector said interior of said chamber;

(c) at least one air blade orifice defined in a second side wall, said second side wall being opposite said first side wall, and said at least one air blade orifice facilitating at least a functional connection between said exterior of said chamber and said interior of said chamber;

(d) said dust collector having an output exhaust for expelling air that remains after said dust collector filters the combined air and contaminants drawn from said chamber;

(e) at least one exhaust orifice defined in one of said at least two enclosing panels; and (f) said output exhaust functionally connected to at least one of said at least one exhaust orifices;

(g) wherein at least one air blade is created when said intake vacuum draws air from said exterior of said chamber into said interior of said chamber through said at least one air blade orifice, said at least one air blade for dislodging contaminants from an occupant within said chamber;

(h) wherein at least one air blade is created when said output exhaust pushes air expelled from said dust collector into said interior of said chamber through said at least one of said at least one exhaust orifices, said air blade for dislodging contaminants from an occupant within said chamber.

29. An air shower system for use with a dust collector having an intake vacuum, said system comprising:

(a) a chamber having at least two enclosing panels, said chamber having an interior and an exterior;

(b) at least one vacuum orifice defined in one of said at least two enclosing panels, said at least one vacuum orifice positioned in a lower portion of said one of said at least two enclosing panels, said intake vacuum functionally connectable to at least one of said at least one vacuum orifices;

(c) a plurality of air blade orifices defined in at least one of said at least two enclosing panels;

(d) said dust collector having an output exhaust for expelling air that remains after said dust collector filters the combined air and contaminants drawn from said chamber;

(e) at least one exhaust orifice defined in one of said at least two enclosing panels; and (f) said output exhaust functionally connected to at least one of said at least one exhaust orifices;

(g) wherein a plurality of air blades is creatable when said intake vacuum draws air from said exterior of said chamber into said interior of said chamber through said plurality of air blade orifices, said plurality of air blades for dislodging contaminants from an occupant within said chamber;

(h) wherein at least one air blade is created when said output exhaust pushes air expelled from said dust collector into said interior of said chamber through said at least one of said at least one exhaust orifices, said air blade for dislodging contaminants from an occupant within said chamber.

30. The air shower system of claim 29, said system comprising:

(a) said chamber having at least two enclosing panels including at least four side walls, a ceiling, and a floor;

(b) at least one vacuum orifice defined in a first side wall; and (c) a plurality of air blade orifices defined in a second side wall, said second side wall being opposite said first side wall.

31. The air shower system of claim 29, said intake vacuum drawing air at a vacuum power of at least 20'000 CFM at 12-14" water.

32. The air shower system of claim 29, said dust collector capable of moving very large volumes of air at low pressure.

33. The air shower system of claim 29, said at least two enclosing panels surrounding said at least one vacuum orifice being sufficiently rigid to prevent said at least two enclosing panels from bending when said intake vacuum draws air.

* * * * *